United States Patent [19]

Hatfield

[11] Patent Number: 4,703,716

[45] Date of Patent: Nov. 3, 1987

[54] CARRIER ASSEMBLY AND DEVICE FOR USE IN A PAINT SPRAY SYSTEM

[75] Inventor: Raymond W. Hatfield, Warren, Mich.

[73] Assignee: Michael Ladney, Grosse Pointe Shores, Mich.

[21] Appl. No.: 848,818

[22] Filed: Apr. 7, 1986

[51] Int. Cl.[4] ..... B05B 5/02

[52] U.S. Cl. ..... 118/500; 118/635

[58] Field of Search ..... 118/500, 501, 635, 324, 118/630, 631, 632, 633, 634

[56] References Cited

U.S. PATENT DOCUMENTS 3,937,180 2/1976 Wiggins ..... 118/635

4,120,261 10/1978 Hafele ..... 118/635 X

*Primary Examiner*—John P. McIntosh

*Attorney, Agent, or Firm*—Brooks & Kushman

[57] ABSTRACT

A secondary spindle or device is utilized with an overhead conveyor and a primary spindle to prevent solidified paint particles that may have built up on the conveyor from falling onto newly painted parts supported on the primary spindle. The primary spindle is suspended from the conveyor at attachment points. The secondary spindle includes a non-conductive plastic shield which is also suspended from the conveyor by a conductive support bracket so that both the primary spindle and the secondary spindle move together with the overhead conveyor. The shield includes a plurality of relatively small holes extending completely therethrough to allow cleaning solution to flow therethrough while preventing solidified paint particles from falling therethrough.

17 Claims, 3 Drawing Figures

CARRIER ASSEMBLY AND DEVICE FOR USE IN A PAINT SPRAY SYSTEM

TECHNICAL FIELD

The invention relates to carrier assemblies and devices in such assemblies for carrying parts in paint spray systems and, in particular to carrier assemblies and devices utilized therein for carrying plastic parts which are to be painted with electrostatically charged paint particles.

BACKGROUND ART

Electrostatic paint overspray naturally builds up on the paint carrier and conveyor structures such as an overhead conveyor. Such buildup requires frequent cleaning and high part reject rates due to solidified particles dropping down upon newly painted part surfaces.

Various prior art patents have attempted to deal with the problem of paint overspray and other problems in systems wherein paint is sprayed on parts supported on a spindle suspended from a moving conveyor.

For example, the Bagby et al U.S. Pat. No. 4,289,090 discloses an electrostatically isolated carrier for painting apparatus. The apparatus includes a rail member having a pair of electrically insulated sleeve members for carrying workpieces to be painted. The work pieces are normally carried by electrically non-conductive hooks which are coated with a plastic material which is nylon. The insulated sleeves may comprise polypropylene or nylon.

The Pfender U.S. Pat. No. 4,290,383 discloses an electrostatic paint spraying arrangement wherein excess paint or coating material is deposited on a backup shield which is porous to absorb excess paint or coating material, thereby minimizing paint overspray.

The Richards et al U.S. Pat. No. 4,325,319 discloses an air flow system for the charging conductor in an electrostatic painting system whereby the air flow system is utilized to prevent paint particles from depositing on the conductor and to avoid deposition of paint on charged conductors. A rack has a flat disc shape which is hung from a conveyor from which workpieces to be painted are suspended.

The Hafele et al U.S. Pat. No. 4,120,261 discloses an electrostatic coating system within a workpiece charging system. A rack having a flat disc shape from which workpieces are suspended is, in turn, suspended from a conveyor.

The Bagby et al U.S. Pat. No. 4,158,344 discloses an electrostatic coating system having means for directing an electrostatic charge to a workpiece carried on a supporting hook. The supporting hook, in turn, is hung from a rack which has a flat disc-shaped configuration and is, in turn, hung from a conveyor.

Despite the teachings of the prior art there is a need for a device which is not only capable of catching solidified paint particles which fall off the conveyor during use, but also is capable of electrically insulating or shielding electrostatically charged paint particles from the conveyor.

DISCLOSURE OF THE INVENTION

An object of the present invention is to provide a carrier assembly and device utilized therewith to prevent solidified paint particles that may have built up on a conveyor of the assembly from falling on a newly painted part supported on a spindle of the assembly.

Another object of the present invention is to provide an assembly and a device utilized therewith that not only prevents solidified paint particles that may have built up on a conveyor of the assembly from falling on a newly painted part supported on a spindle of the assembly, but also to electrically insulate the electrostatically charged paint particles from the conveyor.

In carrying out the above objects and other objects of the present invention, an assembly for carrying parts in a system for painting the parts with electrostatically charged paint particles is provided. The assembly comprises an overhead conveyor, a primary spindle suspended from the conveyor at attachment points and a secondary spindle having a horizontally extending upper surface vertically positioned between the conveyor and the primary spindle. The primary spindle and the secondary spindle move with the conveyor. The primary spindle is adapted to receive and retain at least one part to be painted. The secondary spindle prevents solidified paint particles that have built up on the conveyor from falling on a newly painted part supported on the primary spindle.

Further in carrying out the above objects and other objects of the present invention, a secondary spindle device is provided having an upper surface adapted to be vertically positioned between the conveyor and the primary spindle and to move in synchronization therewith to prevent solidified paint particles that may have built up on the conveyor from falling on a newly painted part supported on the primary spindle.

Preferably, the upper surface of the secondary spindle is defined by a non-conductive shield which electrically insulates the electrostatically charged paint particles from the conveyor and the attachment points.

Also, preferably, the shield comprises a non-conductive nylon shield which is injection-molded to the shape of the shield. The secondary spindle also preferably includes a support member attached to the shield and adapted to removably suspend the secondary spindle from the conveyor.

An assembly and device as constructed above provides numerous advantages. For example, the shield of the secondary spindle catches solidified paint particles that fall off the conveyor or off the attachment points between the primary spindle and the conveyor so that the particles do not blemish newly painted parts supported on the primary spindle. Also, by making the shield from a non-conductive plastic, the conveyor and the primary spindle attachment points are insulated from the electrostatically charged spray paint particles and, consequently, the conveyor and the attachment points remain relatively free from paint spray buildup. Finally, if the secondary spindle is formed with drain holes, a cleaning solution which may appear at the top surface of the secondary spindle may fall therethrough, yet, at the same time, prevent solidified paint particles from falling therethrough.

The objects, features and advantages of the present invention are readily apparent from the following detailed description of the best mode when taken in connection with the accompanying drawings.

BEST MODE FOR CARRYING OUT THE INENTION

Figure 1:
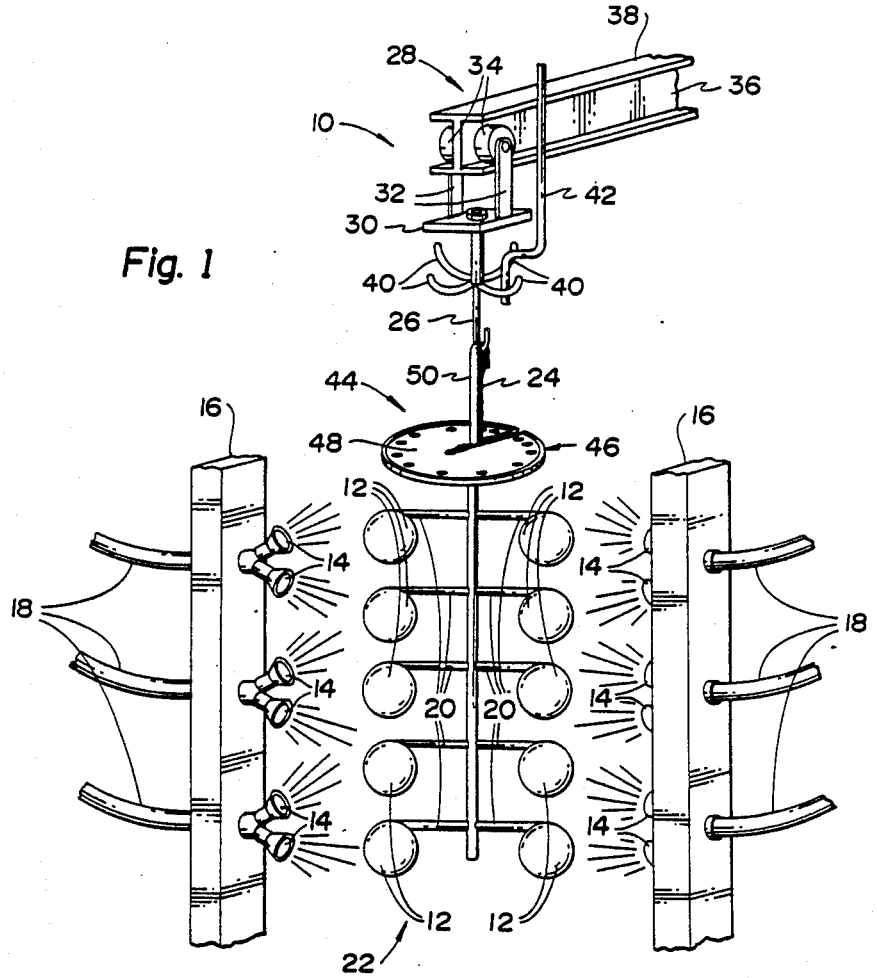
FIG. 1 is a partially broken away perspective and environmental view of a carrier assembly and device utilized therein constructed in accordance with the present invention.
Figure 2:
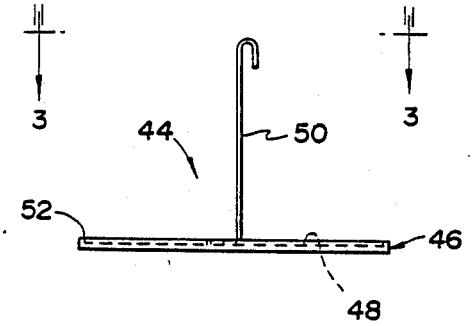
FIG. 2 is a side elevational view of the secondary spindle device constructed in accordance with the present invention.

Referring now to the drawings, there is illustrated in FIG. 1 an assembly, generally indicated at 10, constructed in accordance with the present invention for carrying parts in a system for painting the parts with electrostatically charged paint particles. Preferably, the parts comprise plastic parts 12 which are painted with charged paint particles discharged from conventional sprayer heads 14 which are supported in spaced relationship by support members 16. Paint is supplied in a conventional fashion to the spray heads 14 through paint hoses 18.

The plastic parts are supported or carried on laterally extending arms 20 of a primary spindle, generally indicated at 22. An upper portion of the primary spindle 22 comprises a hook-shaped support member 24 which allows the primary spindle 22 to be suspended from a corresponding downwardly extending hook 26 of an overhead conveyor or conveyor assembly, generally indicated at 28. The hook 26 is rotatably supported by a plate 30 which, in turn, is suspended by spaced legs 32 from rollers 34. The legs 32 are rotatably connected to the rollers 34 which roll in guideways 36 defined by an I-beam 38 of the conveyor 28.

The conveyor hook 26 also includes laterally extending hook portions 40 which engage a downwardly extending alignment bar 42 to position the primary spindle 22 between the banks of spray heads 14 so that the plastic parts 12 are properly painted.

The assembly 10 also includes a secondary spindle device, generally indicated at 44, which is also suspended from the conveyor hook 26. The secondary spindle 44 includes a non-conductive disc-shaped plastic shield, generally indicated at 46. Preferably, the shield 46 is injection molded from a temperature resistant nylon plastic. The shield 46 is riveted to a conductive hanging bracket or support member 50 at its upper surface 48. Preferably, the hanging bracket 50 is metal and is hook-shaped at its upper portion.

A rim 52 is integrally formed on the upper surface 48 of the shield 46 about its outer periphery to retain solidified paint particles on the upper surface 48. Such paint particles may have previously fallen from the conveyor 28 or the attachment points between the primary spindle 22 and the conveyor 28. If such paint particles fall on newly painted plastic parts 12, they will mar their finish.

The shield 46 is formed with a radially extending elongated slot 54 to allow the secondary spindle 44 to be readily suspended from the support hook 26 while permitting the primary spindle 22 to extend therethrough. Because the shield 46 is formed from a non-conductive plastic, the conveyor 28 and the attachment points between the conveyor 28 and the primary spindle 22 are insulated or shielded from the electrostatically charged paint spray particles.

Figure 3:
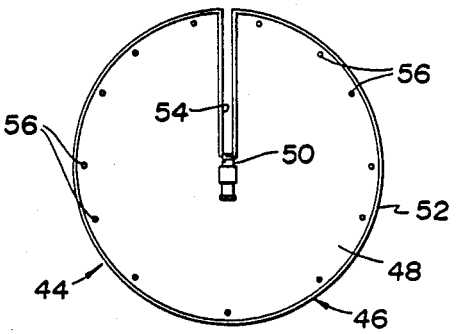
FIG. 3 is a top plan view of the device taken along lines 3—3 of FIG. 2.

Referring now to FIG. 3, a plurality of peripherally spaced, drain holes 56 are formed through the shield 46 between its upper surfaces to allow a cleaning solution to drain therethrough. Such a cleaning solution is typically sprayed on the plastic parts 12 as they are conveyed by the conveyor 28 prior to painting. The diameter of the holes 56, however, are small enough to prevent solidified paint particles from falling therethrough onto the parts 12.

The advantages of an assembly 10 including a secondary spindle device 44 as constructed above are numerous. For example, the shield 46 of the secondary spindle 44 catches solidified paint particles which may have accumulated on the conveyor 28 or the attachment points between the conveyor 28 and the primary spindle 22. Furthermore, because the shield 46 is non-conductive, the conveyor 18 and the attachment points between the conveyor 28 and the primary spindle 22 are insulated or shielded from the electrostatically charged paint particles, thereby hindering paint spray buildup. Finally, relatively small drain holes are formed through the shield 46 to permit cleaning solution to flow therethrough, yet are small enough to prevent solidified paint particles from falling therethrough and onto freshly painted part surfaces. If such particles fall on such painted surface, such plastic parts are typically rejected as being unsatisfactory. Also, down time of the conveyor is minimized in that the conveyor need not be cleaned as frequently due to the buildup of paint thereon.

While a preferred embodiment of a carrier assembly and a spindle device have been shown and described herein in detail, those skilled in this art will recognize various alternative designs and embodiments for practicing the present invention as defined by the following claims.

What is claimed is:

1. An assembly for carrying parts in a system for painting the parts with electrostatically charged paint particles, the assembly comprising:

an overhead conveyor;

a primary spindle suspended from said conveyor at attachment points to move therewith and adapted to receive and retain at least one part to be painted; and a secondary spindle having an upper surface vertically positioned between said conveyor and said primary spindle to move in synchronism therewith to prevent solidified paint particles that may have built up on the conveyor fram falling on a newly painted part supported on the primary spindle wherein said upper surface is defined by a non-conductive shield to electrically insulate the electrostatically charged paint particles from the conveyor and the attachment points during painting.

2. The assembly as claimed in claim 1 wherein said shield comprises a non-conductive plastic shield.

3. The assembly as claimed in claim 2 wherein said non-conductive plastic comprises nylon injection molded to the shape of the shield.

4. The assembly as claimed in claim 1 wherein said secondary spindle includes a support member attached to said shield for removably suspending the secondary spindle from said conveyor.

5. The assembly as claimed in claim 4 wherein said support member is conductive.

6. The assembly as claimed in claim 1 wherein the parts to be painted comprise plastic parts and wherein said primary spindle is conductive.

7. The assembly as claimed in claim 1 wherein said shield includes a plurality of relatively small holes extending completely therethrough to fluidly communicate the upper surface and its lower surface and having a cross section of a size to prevent solidified paint particles from falling therethrough, but allowing a cleaning solution located on the upper surface to flow therethrough.

8. The assembly as claimed in claim 1 wherein said shield is disc-shaped and has an aperture extending completely therethrough, a portion of said primary spindle extending through said aperture.

9. The assembly as claimed in claim 8 wherein said disc-shaped shield has a rim formed about its outer periphery on the upper surface thereof to maintain any solidified paint particles on the upper surface.

10. In an assembly for carrying parts to be painted with electrostatically charge paint particles, the assembly including an overhead conveyor and a primary spindle suspended from the conveyor at attachment points to move therewith and adapted to receive and retain at least one part to be painted, the invention comprising:

a secondary spindle device having an upper surface vertically positioned between the conveyor and the primary spindle and to move in synchronism therewith to prevent solidified paint particles that may have built up on the conveyor from falling on a newly painted part supported on the primary spindle wherein said upper surface is defined by a non-conductive shield to electrically insulate the electrostatically charged paint particles from the conveyor and the attachment points during painting.

11. The device as claimed in claim 10 wherein said shield comprises a non-conductive plastic shield.

12. The device as claimed in claim 11 wherein said non-conductive plastic comprises nylon injection molded to the shape of the shield.

13. The device as claimed in claim 10 wherein said secondary spindle includes a support member attached to said shield and adapted to removably suspend the device from said conveyor.

14. The device as claimed in claim 13 wherein said support member is conductive.

15. The device as claimed in claim 10 wherein said shield includes a plurality of relatively small holes extending completely therethrough to fluidly communicate the upper surface and its lower surface and having a cross section of a size to prevent solidified paint particles from falling therethrough, but allowing a cleaning solution located on the upper surface to flow therethrough.

16. The device as claimed in claim 15 wherein said shield is disc-shaped and has a aperture extending completely therethrough, said aperture being adapted to permit a portion of the primary spindle to extend therethrough.

17. The device as claimed in claim 16 wherein said disc-shaped shield has a rim formed about its outer periphery on the upper surface thereof to maintain any solidified paint particles on the upper surface.

* * * * *